United States Patent [19]

Vardi et al.

[11] Patent Number: 4,826,506

[45] Date of Patent: May 2, 1989

[54] USE OF POLYHYDRIC ALCOHOLS TO REDUCE LOSS OF AMINE OXIDES FROM LIQUID HYDROCARBON FUELS

[75] Inventors: Joseph Vardi, Demarest; Abraham A. Zimmerman, Warren, both of N.J.

[73] Assignee: Exxon Research and Engineering Company, Florham Park, N.J.

[21] Appl. No.: 130,467

[22] Filed: Dec. 9, 1987

[51] Int. Cl.[4] ..... C10L 1/18

[52] U.S. Cl. ..... 44/63; 44/72; 44/77

[58] Field of Search ..... 44/72, 77, 63

[56] References Cited

U.S. PATENT DOCUMENTS

| | | | |
|---|---|---|---|
| 1,665,621 | 4/1928 | Chandler | 44/72 |
| 3,007,784 | 11/1961 | Ebner | 44/72 |
| 3,387,953 | 6/1968 | Bouffard | 44/72 |
| 3,594,139 | 7/1971 | Bouffard | 44/72 |

*Primary Examiner*—Jacqueline V. Howard

*Attorney, Agent, or Firm*—John W. Ditsler

[57] ABSTRACT

Certain polyhydric alcohols have been found to be effective in reducing the loss of certain amine oxides from liquid hydrocarbon fuels such as gasoline.

30 Claims, No Drawings

USE OF POLYHYDRIC ALCOHOLS TO REDUCE LOSS OF AMINE OXIDES FROM LIQUID HYDROCARBON FUELS

BACKGROUND OF THE INVENTION

1. Field of the Invention

The present invention relates to a method for reducing the loss of amine oxides from liquid hydrocarbon fuels.

2. Description of Related Art

Amine oxides have been used in hydrocarbon fuels for a number of years, principally as rust inhibition and/or anti-icing agents in gasoline (see for example U.S. Pat. Nos. 3,387,953 and 3,594,139, the disclosures of which are incorporated herein by reference). More recently, certain amine oxides have been used to reduce and/or eliminate injector fouling in a multiport electronically controlled fuel injected engine.

However, amine oxides are water soluble and have a tendency to be attracted to water because of their polarity. Thus, when water is present in, or in contact with, a fuel or in a storage tank containing said fuel, the amine oxides will be partially extracted into the water phase. This is undesirable because the fuel will be deprived of the beneficial effects of said oxides. In addition, a high concentration of amine oxides in the water phase is undesirable as they tend to cause the formation of an oily, viscous third phase which could have deleterious effects on fuel delivery systems. Accordingly, it would be desirable to have available a simple and convenient method to reduce the loss of amine oxides from a liquid hydrocarbon fuel into said water phase.

SUMMARY OF THE INVENTION

Now according to one embodiment of the present invention, a method has been discovered for reducing the loss of certain amine oxides present in a liquid hydrocarbon fuel into a water phase in contact with said fuel. More particularly, it has been found that introducing certain polyhydric alcohols into a liquid hydrocarbon fuel such as gasoline is effective in reducing the loss of the amine oxides from said fuel by the extraction of said oxides into said water phase. Suitable polyhydric alcohols are those having at least two hydroxy groups and at least 4 carbon atoms.

In another embodiment, the present invention concerns a fuel composition which comprises a liquid hydrocarbon fuel such as gasoline, certain amine oxides and certain polyhydric alcohols, each of which are described hereinafter. When the fuel is gasoline, the composition is particularly well suited for use in spark fired internal combustion engines.

DETAILED DESCRIPTION OF THE INVENTION

The particular amine oxides to which the present invention is directed are those having the general formula:

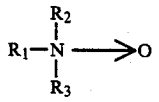

wherein $R_1$ is $C_6$–$C_{24}$ alkyl, aryl, cycloaliphatic, heterocyclic, substituted alkyl, substituted aryl; $R_2$ and $R_3$ independently are $C_1$–$C_{24}$ alkyl, aryl, substituted alkyl or aryl, cycloaliphatic, heterocyclic, and mixtures thereof. Preferred amine oxides include those in which $R_1$ is $C_6$–$C_{20}$ alkyl, or alkylated aryl; and $R_2$ and $R_3$ independently are $C_1$–$C_{12}$ hydroxy substituted alkyl groups. Most preferably, $R_1$ comprises $C_8$–$C_{18}$ substituents derived from fatty acids, and $R_2$ and $R_3$ are independently $C_1$—$C_{12}$ hydroxy terminated alkyl groups. Preferred amine oxides are those selected from the group consisting of bis(2-hydroxy ethyl) cocoamine oxide, bis(2-hydroxy ethyl) stearylamine oxide, dimethylcocoamine oxide, dimethyl hydrogenated tallow amine oxide, dimethylhexadecylamine oxide and mixtures thereof. The amine oxides referred to herein may be prepared in accordance with known techniques, such as is disclosed in U.S. Pat. No. 3,387,953. The present invention is particularly useful when bis(2-hydroxy ethyl) cocoamine oxide is in the fuel.

Any of the aliphatic polyhydric alcohols having at least two hydroxy groups and at least four carbon atoms can be used in the present invention. Typically, the alcohols used will contain no more than 24 carbon atoms, although alcohols having a greater number of carbon atoms may be used. Alcohols containing 2 hydroxy groups and from 4 to 10 carbon atoms are preferred. Specific examples of alcohols which may be used include hexylene glycol, butylene glycol, pentylene glycol and the like. Hexylene glycol is particularly preferred. However, the other polyhydric alcohols may also provide a substantial reduction in the water extraction of amine oxides from the liquid hydrocarbon fuel.

The amount of polyhydric alcohol added to the liquid hydrocarbon fuel according to the present invention can vary broadly, but need only be an amount sufficient to inhibit and/or reduce the extraction (or loss) of amine oxides from the liquid hydrocarbon fuels. Moreover, the amount of polyhydric alcohol required will vary with temperature, with greater amounts being required as the temperature of the fuel is reduced because the solubility of the amine oxides in liquid hydrocarbon fuels is lower at lower temperatures. Accordingly, the amount of polyhydric alcohol used will be at least 50 (preferably at least 100) vppm and, typically, will range from about 50 (preferably from about 100) to about 1000 vppm, although larger amounts may be used, particularly at lower temperatures. Preferably, from about 200 to about 600 vppm of the polyhydric alcohol will be used.

The present invention may be carried out over a broad range of temperatures (typically from about −35° to about 40° C.), provided the fuel remains in the liquid phase. More typically, the temperature will range from about −10° to about 35° C. The present invention will normally be carried out at ambient pressures. In addition, the contact time between the amine oxide and the polyhydric alcohol in the fuel can vary, but need only be that sufficient to effect a reduction in the loss of said oxide to the water phase.

The liquid hydrocarbon fuel used in the present invention may vary broadly and can be derived from either natural or synthetic sources. Usually, the fuel will be a commercial grade gasoline which generally will comprise cracked gasoline, hydrocracked gasoline, reformed gasoline, alkylate, isoparaffins, aromatics and the like, or mixtures thereof. The fuel may contain lead or be unleaded.

As used herein, the "water phase" in contact with the hydrocarbon fuel can be dispersed as small water droplets in said fuel. The water phase can also refer to the interface of the fuel with a separate water phase. Typically, the amount of water in contact with said fuel will vary from about 100 to about 2000 vppm, although larger (or smaller) amounts may be present.

In addition to the amine oxides and polyhydric alcohols, other additives may also be added to the liquid hydrocarbon fuel. Such additives include antioxidants, rust inhibitors, other detergents, dyes, carburetor deicing agents, mineral oils and the like.

The present invention may be further understood by reference to the following examples which are not intended to restrict the scope of the claims appended hereto.

EXAMPLE 1

100 ml portions of gasoline containing bis(2-hydroxy ethyl) cocoamine oxide were placed in fourteen centrifuge tubes (8 inch cone shaped) with a narrow tip. A known amount of hexylene glycol was added to twelve tubes using a precision sampling syringe. Fourteen tubes were then placed in an ultrasonic bath for intimate mixing. 100 microliters of terminal water bottoms were then added to each tube and dispersed into the gasoline using the ultrasonic bath. The amount of water added is equivalent to 0.1 vol. % water in gasoline, which is typical of levels present in terminal tanks. The gasoline was left undisturbed for about 24 hours to allow extraction and settling of water droplets. Typically about 80% of the added water was settled after 24 hours. At the end of the 24 hours, 95% of the gasoline was removed from the tube (using a pipette) without disturbing the water phase. The amount of bis(2-hydroxy ethyl) cocoamine oxide in the gasoline was then determined (in pounds per thousand barrels) by gas chromatography using a capillary column and a nitrogen detector. The results at room temperature (about 22° C.) are summarized in Table 1 below:

TABLE 1

| Hexylene Glycol | Cocoamine Oxide Conc., ptb | | % Loss of |
|---|---|---|---|
| vppm | Initial | Final | Cocoamine Oxide |
| 0 | 8.5 | 5.7 | 33 |
| 100 | 8.5 | 7.4 | 13 (1) |
| 200 | 8.3 | 7.0 | 16 |
| 400 | 8.3 | 7.7 | 7 |
| 600 | 11.8 | 12.2 (2) | 0 |
| 800 | 11.8 | 12.2 (2) | 0 |
| 1000 | 8.2 | 8.9 (2) | 0 |

(1) Somewhat lower than expected but within the accuracy of the analysis method used.
(2) All "final" values reported are believed to be somewhat higher than their true value due to minor gasoline evaporation during the test.

EXAMPLE 2

Using the same procedure as in Example 1, additional data were obtained for tubes placed in a freezer at a temperature of about −4° C. The results are shown below in Table 2 below.

TABLE 2

| Hexylene Glycol | Cocoamine Oxide Conc., ptb | | % Loss of |
|---|---|---|---|
| vppm | Initial | Final | Cocoamine Oxide |
| 0 | 8.2 | 3.5 | 57 |
| 100 | 8.5 | 4.4 | 48 |
| 200 | 8.3 | 4.4 | 47 |
| 400 | 8.3 | 4.8 | 42 |
| 600 | 11.7 | 12.2 (1) | 0 |

TABLE 2-continued

| Hexylene Glycol | Cocoamine Oxide Conc., ptb | | % Loss of |
|---|---|---|---|
| vppm | Initial | Final | Cocoamine Oxide |
| 800 | 11.7 | 12.2 (1) | 0 |
| 1000 | 8.2 | 6.6 | 19 (2) |

(1) Same as note (2) in Table 1.
(2) Data suggests percent loss at 1000 vppm hexylene glycol is negligible and that the reported value was due to an experimental error.

The data in Tables 1 and 2 show that a polyhydric alcohol such as hexylene glycol can effectively reduce the water extraction of an amine oxide such as cocoamine oxide, with greater amounts of alcohol being required at lower temperature to achieve the same percent reduction in amine oxide loss.

What is claimed is:

1. A method for reducing the loss of amine oxides from a liquid hydrocarbon fuel which is in contact with a water phase, said amine oxides having the formula

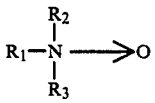

wherein $R_1$ is $C_6$ to $C_{24}$ alkyl, aryl, cycloaliphatic, heterocyclic, substituted alkyl or substituted aryl; $R_2$ and $R_3$ independently are $C_1$ to $C_{24}$ alkyl, aryl, substituted alkyl or aryl, cycloaliphatic or heterocyclic or mixtures thereof, which comprises contacting said oxide in the fuel with a polyhydric alcohol having at least two hydroxy groups and at least four carbon atoms wherein the volume ratio of polyhydric alcohol to amine oxide is between 3.9 and 40.5.

2. The method of claim 1 wherein said polyhydric alcohol contains from 4 to 10 carbon atoms.

3. The method of claim 2 wherein said polyhydric alcohol is selected from the group consisting of hexylene glycol, pentylene glycol, butylene glycol and mixtures thereof.

4. The method of claim 3 wherein said polyhydric alcohol comprises hexylene glycol.

5. The method of claim 1 wherein $R_1$ is $C_6$ to $C_{20}$ alkyl, or alkylated aryl; and, $R_2$ and $R_3$ independently are $C_1$ to $C_{12}$ hydroxy substituted alkyl groups.

6. The method of claim 5 wherein $R_1$ comprises $C_8$ to $C_{18}$ alkyl groups.

7. The method of claim 6 wherein $R_1$ comprises $C_8$–$C_{18}$ substituents derived from fatty acids.

8. The method of claim 7 wherein $R_2$ and $R_3$ independently are $C_1$ to $C_{12}$ hydroxy terminated alkyl groups.

9. The method of claim 1 wherein said amine oxide is selected from the group consisting of bis(2-hydroxy ethyl) cocoamine oxide, bis(2-hydroxy ethyl) tallow amine oxide, bis(2-hydroxy ethyl) stearylamine oxide, dimethylcocoamine oxide, dimethyl hydrogenated tallow amine oxide, dimethylhexadecylamine oxide) and mixtures thereof.

10. The method of claim 9 wherein said amine oxide comprises bis(2-hydroxy-ethyl) cocoamine oxide.

11. A method for reducing the loss of amine oxides from gasoline which is in contact with a water phase, wherein said amine oxide is selected from the group consisting of bis(2-hydroxy ethyl) cocoamine oxide, bis(2-hydroxy ethyl) tallow amine oxide, bis (2-hydroxy ethyl) stearylamine oxide, dimenthylcocoamine oxide, dimethyl hydrogenated tallow amine oxide, dimethylhexadecylamine oxide and mixtures thereof, which comprises contacting said oxide in the gasoline with a polyhydric alcohol having two hydroxy groups and from 4 to 10 carbon atoms wherein the volume ratio of polyhydric alcohol to amine oxide is between 3.9 and 40.5.

12. The method of claim 11 wherein said polyhydric alcohol is selected from the group consisting of hexylene glycol, pentylene glycol, butylene glycol and mixtures thereof.

13. The method of claim 12 wherein said polyhydric alcohol comprises hexylene glycol.

14. The method of claim 13 wherein said amine oxide comprises bis(2-hydroxy ethyl) cocoamine oxide.

15. The method of claim 14 wherein said gasoline is unleaded.

16. A liquid hydrocarbon fuel composition which comprises a (1) liquid hydrocarbon fuel, (2) at least one polyhydric alcohol having at least two hydroxy groups and at least four carbon atoms and (3) at least one amine oxide having the formula

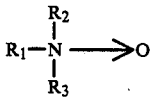

wherein $R_1$ is $C_6$ to $C_{24}$ alkyl, aryl, cycloaliphatic, heterocyclic substituted alkyl or substituted aryl; $R_2$ and $R_3$ independently are $C_1$ to $C_{24}$ alkyl, aryl, substituted alkyl or aryl, cycloaliphatic or heterocyclic or mixtures thereof and wherein the volume ratio of polyhydric alcohol to amine oxide is between 3.9 and 40.5.

17. The composition of claim 16 wherein said polyhydric alcohol contains from 4 to 10 carbon atoms.

18. The composition of claim 17 wherein said polyhydric alcohol is selected from the group consisting of hexylene glycol, pentylene glycol, butylene glycol and mixtures thereof.

19. The composition of claim 18 wherein said polyhydric alcohol comprises hexylene glycol.

20. The composition of claim 16 wherein $R_1$ is $C_6$ to $C_{20}$ alkyl, or alkylated aryl; and, $R_2$ and $R_3$ independently are $C_1$ to $C_{12}$ hydroxy substituted alkyl groups.

21. The composition of claim 20 wherein $R_1$ comprises $C_8$ to $C_{18}$ alkyl groups.

22. The composition of claim 21 wherein $R_1$ comprises $C_8$–$C_{18}$ substituents derived from fatty acids.

23. The composition of claim 22 wherein $R_2$ and $R_3$ independently are $C_1$ to $C_{12}$ hydroxy terminated alkyl groups.

24. The composition of claim 23 wherein said amine oxide is selected from the group consisting of bis(2-hydroxy ethyl) cocoamine oxide, bis(2-hydroxy ethyl) tallow amine oxide, bis(2-hydroxy ethyl) stearylamine oxide, dimethylcocoamine oxide, dimethyl hydrogenated tallow amine oxide, dimethylhexadecylamine oxide) and mixtures thereof.

25. The composition of claim 24 wherein said amine oxide comprises bis(2-hydroxy ethyl) cocoamine oxide.

26. An improved fuel composition for a spark fired internal combustion engine which comprises (a) gasoline, (b) an amine oxide selected from the group consisting of bis(2-hydroxy ethyl) cocoamine oxide, bis(2-hydoxy ethyl) stearylamine oxide, dimethylcocoamine oxide, dimethyl hydrogenated tallow amine oxide, dimethylhexadecylamine oxide and mixtures thereof and (c) a polyhydric alcohol having two hydroxy groups and from 4 to 10 atoms wherein the volume ratio of polyhydric alcohol to amine oxide is between 3.9 and 40.5.

27. The composition of claim 26 wherein said polyhydric alcohol is selected from the group consisting of hexylene glycol, pentylene glycol, butylene glycol and mixtures thereof.

28. The composition of claim 27 wherein said polyhydric alcohol comprises hexylene glycol.

29. The composition of claim 28 wherein said amine oxide comprises bis(2-hydroxy ethyl) cocoamine oxide.

30. The composition of claim 29 wherein said gasoline is unleaded.

* * * * *